United States Patent [19]

Wein

[11] 4,452,367

[45] Jun. 5, 1984

[54] VARIABLE SIZE BOX CONSTRUCTION

[76] Inventor: Sam Wein, 14983 Tacuba Dr., La Mirada, Calif. 90638

[21] Appl. No.: 494,863

[22] Filed: May 16, 1983

[51] Int. Cl.[3] ..... B65D 5/22; B65D 5/54

[52] U.S. Cl. ..... 229/33; 206/602

[58] Field of Search ..... 229/36, 33, 44; 206/602

[56] References Cited

U.S. PATENT DOCUMENTS

| | | | |
|---|---|---|---|
| 1,738,744 | 12/1929 | Walter | 229/33 |
| 1,793,102 | 2/1931 | Labomearde | 229/33 |
| 1,838,154 | 12/1931 | Raftenberg | 229/33 |
| 2,168,387 | 8/1939 | Bellin | 229/33 |
| 2,210,443 | 8/1940 | Bergstein | 229/33 |
| 2,251,565 | 8/1941 | Forman | 229/36 |
| 2,914,234 | 11/1959 | Hazelwood | 229/31 |
| 3,170,618 | 2/1965 | Sweeney | 229/33 |
| 3,317,115 | 5/1967 | Conescu | 229/33 |
| 3,743,170 | 7/1973 | Ricclo | 229/33 |

*Primary Examiner*—William T. Dixson, Jr.

*Attorney, Agent, or Firm*—Gausewitz, Carr, Rothenberg & Edwards

[57] ABSTRACT

This invention provides a unit for forming alternatively a relatively small box or one-half of a relatively large box. It includes a rectangular cardboard sheet with interconnected doubled over side and end edge panels. Localized parts of the side edge panels are secured by adhesives to the sheet. Score linesare provided for bending and perforations allow severing the side edge panels for making a relatively small box with integral lid. The side edge panels are left intact and the adhesive is torn away in forming one-half of a relatively large box.

9 Claims, 9 Drawing Figures

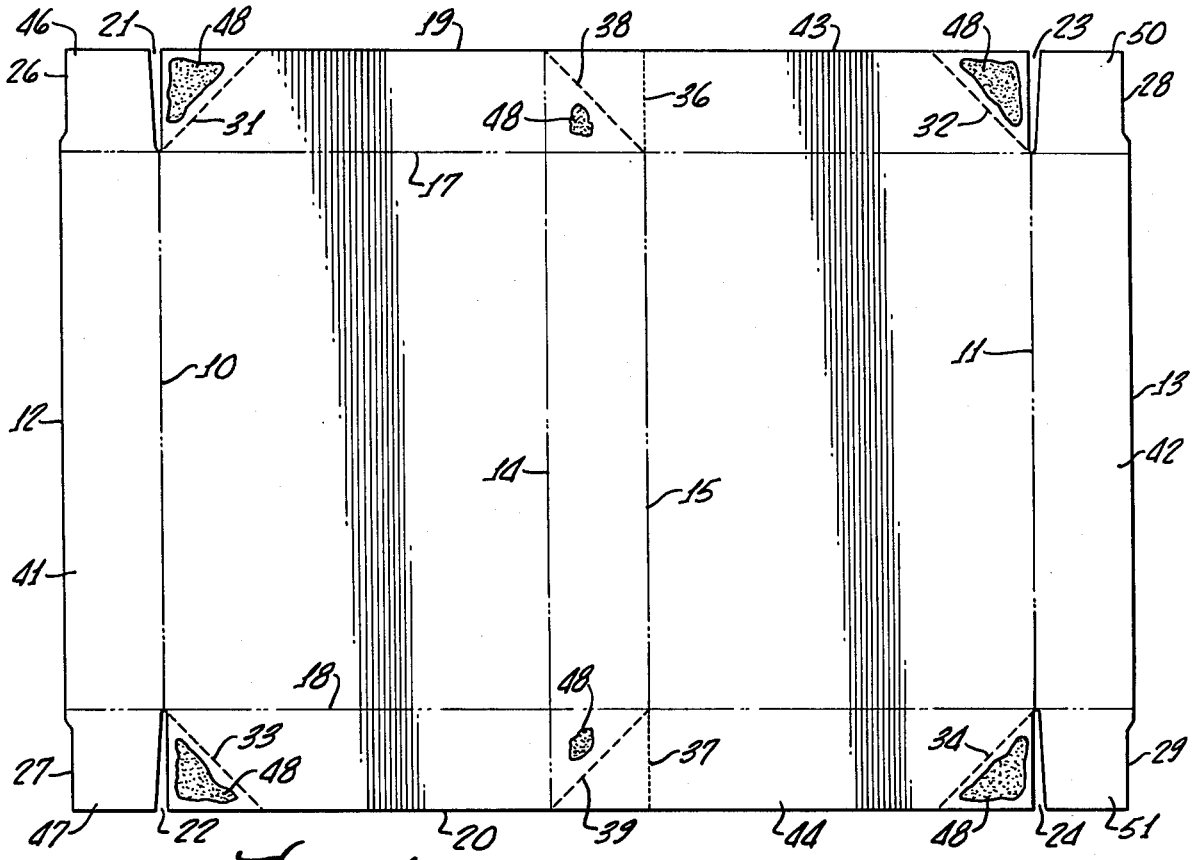
FIG. 1.
FIG. 2.
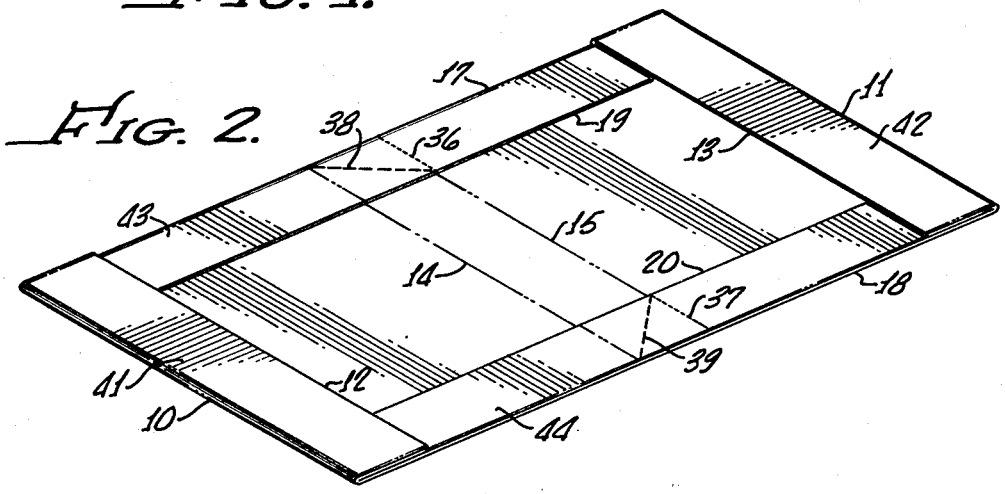
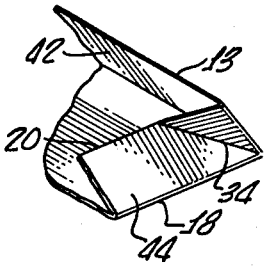
FIG. 3.
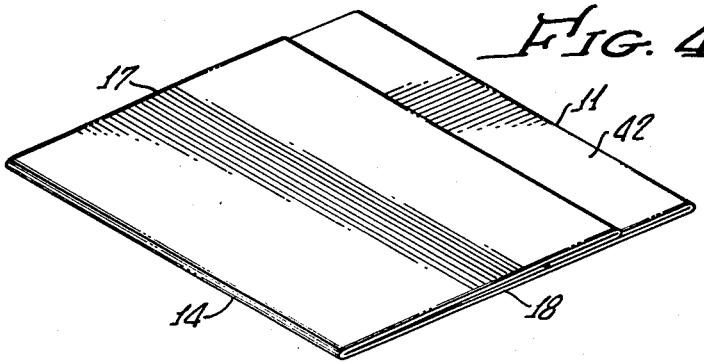
FIG. 4.

FIG. 5.
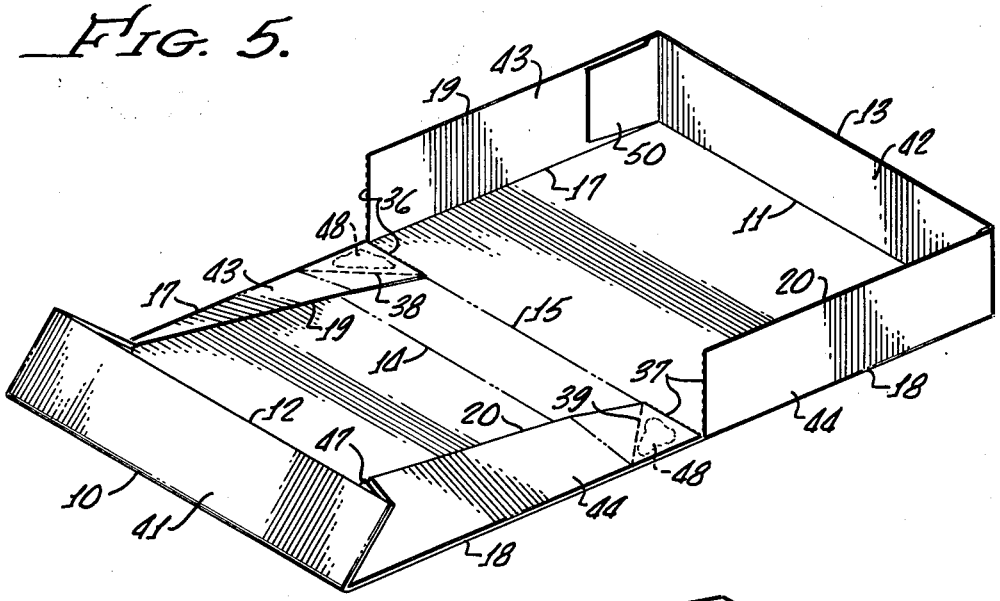
FIG. 6.
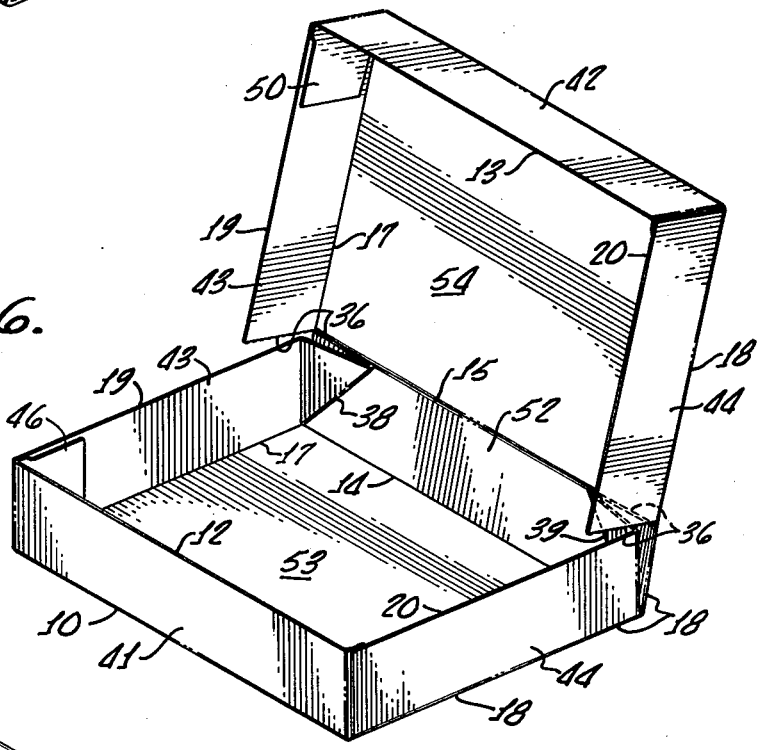
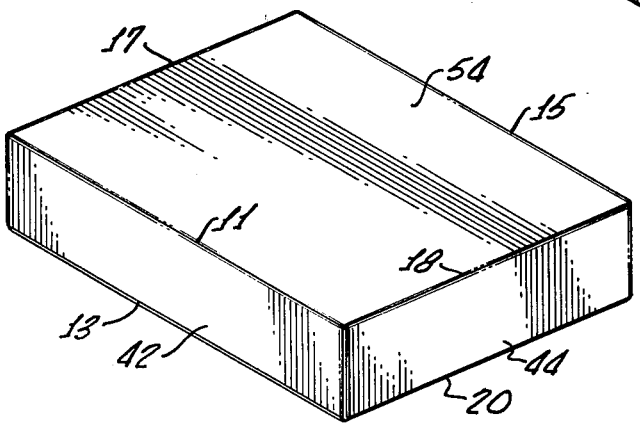
FIG. 7.

VARIABLE SIZE BOX CONSTRUCTION

BACKGROUND OF THE INVENTION

Cardboard boxes for gift and merchandise wrapping conventionally are made of a sheet of material folded flat for storage and opened up for use. The walls of the box in such arrangements are folded over the base sheet and unfolded 90 degrees to make a three-dimensional structure. Although this is a satisfactory way of producing a box, it lacks versatility in that each unit can produce only one size of box. Therefore, to accommodate articles of different sizes, a substantial number of sizes of box units are required. Commercially this leads to a large inventory of different items. Flexibility may be lost in selecting the exact correct size for the box that is to be assembled.

BRIEF SUMMARY OF THE INVENTION

The present invention provides a unit that can be made into a small size box with integral receptacle and lid, or one-half of a large box, at the option of the assembler. When packaged and folded two to a package, the purchaser has the choice of making either two small boxes or one large box from the two units. In commerical use, there is an inventory reduction in that half as many sizes are necessary in the box kits to provide the sizes of boxes needed.

The unit is produced from cardboard, preferably, and consists of a rectangular sheet with the side and end walls connected and doubled over in a generally conventional manner. However, the central portions of the side walls are adhesively secured to the base sheet and perforated adjacent the adhesive connections. For making a small size box, the side walls are torn at the frangible perforations so that they can provide separate walls for the receptacle portion and the lid of the box. However, for making half of a large size box, the perforations are left intact so that the side walls remain unitary. The central adhesive connections of the side walls to the base sheet are separated by tearing so that then side walls can stand at 90 degrees to the entire base sheet to form portions of the lid or receptacle portion of the box to be constructed. There are scores formed in the central portion of the sheet to facilitate the bending necessary when the small size box is made with its integral receptacle and lid. However, for the large size box, the material is not bent along these score lines.

The resulting unit has the obvious advantage of creating two sizes of boxes from a single unit, with the added advantage of being economically produced and very easily manipulated to construct whatever size box is chosen.

BRIEF DESCRIPTION OF THE DRAWINGS

FIG. 1 is a plan view of a sheet of material used in forming the box unit of this invention;

FIG. 2 is a perspective view of the sheet with the side and end walls doubled over the base;

FIG. 3 is a fragmentary, perspective view illustrating the manner in which the side and end walls fold together;

FIG. 4 is a perspective view of the unit in its normal stored and folded condition;

FIG. 5 is a perspective view of the unit being prepared for producing a small size box;

FIG. 6 is a perspective view with the small size box complete and the lid open;

FIG. 7 is a perspective view of the small size box with the lid closed;

DETAILED DESCRIPTION OF THE INVENTION

Figure 8:
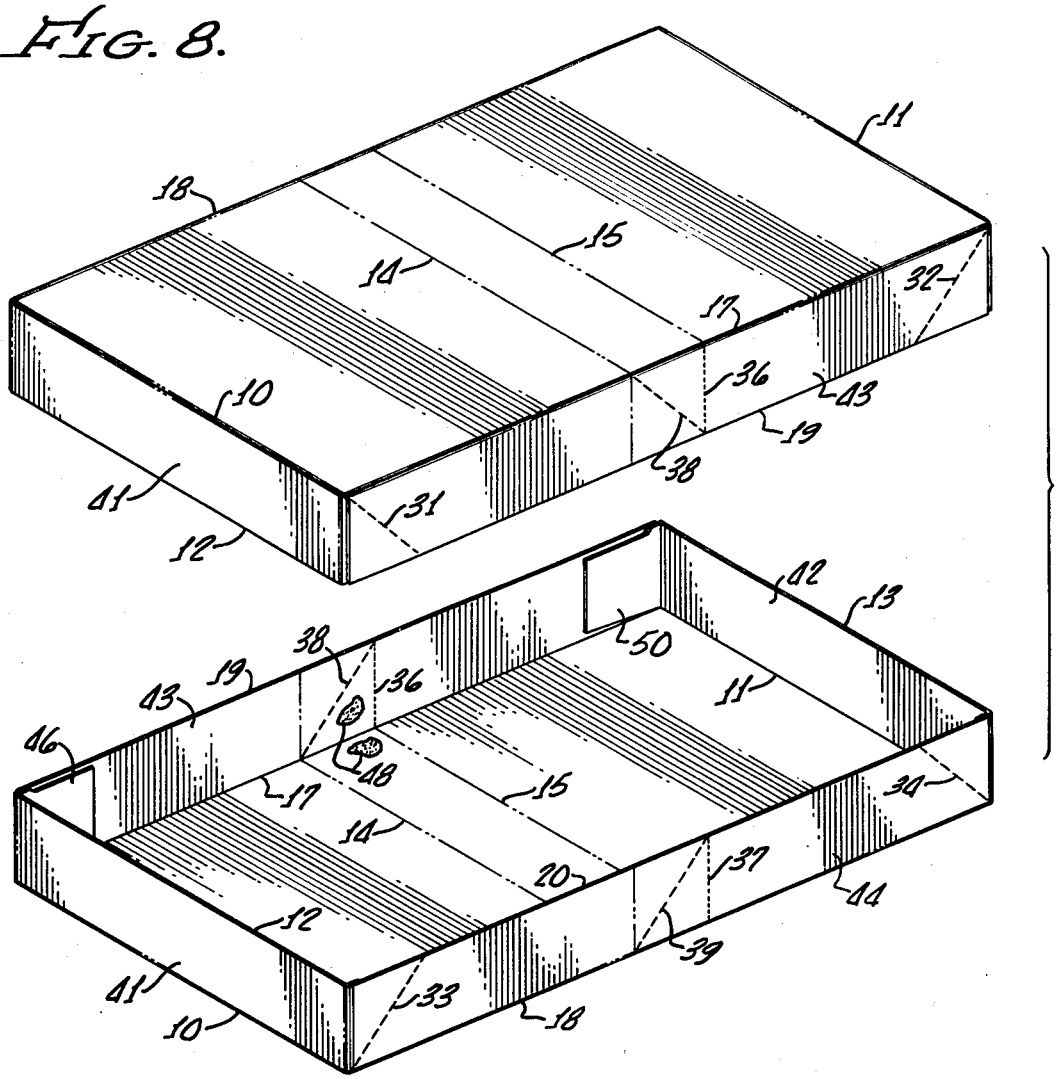
FIG. 8 is a perspective view of two of the units prepared to produce a large size box.

The flat generally rectangular sheet of cardboard seen in FIG. 1 is used in constructing a box in accordance with this invention. The sheet is provided with transverse scores 10 and 11, spaced inwardly equal distances from and parallel to its end edges 12 and 13, respectively. Additional parallel transverse scores 14 and 15 straddle and are equally spaced from the central transverse axis of the sheet, and are spaced apart a distance equal to the distances of the scores 10 and 11 from the end edges 12 and 13. Longitudinal side scores 17 and 18 are inwardly of the side edges 19 and 20 of the sheet, being spaced from these edges the same distance as the scores 10 and 11 are from their adjacent edges. The score 14 extends across the sheets only between the scores 17 and 18, while the score 15 extends the full width of the sheet to the side edges 19 and 20.

Narrow notches 21 and 22 are formed in the sheet, extending inwardly from the side edges 19 and 20, in alignment with the score 10 and with their inner ends at the scores 17 and 18, respectively. Similar notches 23 and 24 are aligned with the score 11 adjacent the opposite end of the sheet.

The side extremities 26 and 27 of the end edge 12, beyond the score lines 17 and 18, are recessed a short distance. The same holds true for the end parts 28 and 29 of the other end edge 13.

The sheet is perforated along a line 31 which is at 45 degrees to the side edge 19, extending between the intersection of the score lines 10 and 17 and the edge 19. The perforation 31 inclines away from the intersection of the lines 10 and 17 and toward the center of the sheet so as to provide a small triangular section bounded by a portion of the edge 19, the perforation 31 and an edge of the notch 21. A similar perforation 32 inclines at a 45 degree angle from the intersection of the score lines 11 and 17 toward the edge 19. Corresponding perforations 33 and 34 are adjacent the opposite side edge of the sheet, inclining from the intersection of the score lines 10 and 18, and 11 and 18, respectively, toward the side edge 20.

Perforations 36 and 37 form continuations of the score line 15, extending respectively between score line 17 and the side edge 19 and the score line 18 and the side edge 20. The perforations 36 and 37 are sufficiently close together to enable the material of the sheet to be torn apart along those lines. The other perforations, however, are merely to facilitate bending of the sheet along the lines of the perforations.

There are additional perforations 38 and 39 to facilitate bending of the sheet that incline at 45 degree angles from the side edge 19 to the intersection of the score lines 14 and 17, and from the side edge 20 to the intersection of the score lines 14 and 18, respectively.

The sheet then is folded to the position of FIG. 2, being bent along the score lines 10, 11, 17 and 18, as well as the perforations 31, 32, 33 and 34. This provides end panels 41 and 42 between the score line 10 and the end edge 12 and the score line 11 and the end edge 13, respectively, which are bent 180 degrees about the score lines 10 and 11 to overlie the main surface of the sheet. They also overlie the side edge panels 43 and 44 which are bent inwardly 180 degrees about the score lines 17 and 18, respectively. The end flaps 46 and 47 of the end panel 41, beyond the score lines 17 and 18, are secured by an adhesive 48 to the triangular parts adjacent the perforations 31 and 33 when the panels 41, 43 and 44 have been bent through 90 degrees about the score lines. Also, the end flaps 50 and 51 of the end panel 42, beyond the score lines 17 and 18, respectively, are secured by additional adhesive 48 to the triangular sections bounded by the perforations 32 and 34 when the panels 42, 43 and 44 have been bent through 90 degrees. The end flaps 46, 47, 50 and 51 are doubled under the end panels 41 and 42, in the manner illustrated in FIG. 3.

An additional, but relatively small, quantity of adhesive 48 secures the side edge panels 43 and 44 to the main body of the sheet. This adhesive attaches to the side edge panels at the triangular segments between the score line 17 and the perforations 36 and 38, in one instance, and the score line 18 and the perforations 37 and 39 in the other.

Preferably for shipping, storing and marketing, the sheet is bent through 180 degrees about the transverse score line 15 to the position of FIG. 4. Thus, it assumes a minimum dimension laterally and has very little thickness. Normally, the units thus folded will be packaged in pairs. This permits the consumer to construct either two relatively small boxes, or one relatively large box from the package.

If a relatively small box is to be made, the unit is opened up to the position of FIG. 2. Then the sheet is torn along the perforations 36 and 37, taking care to leave intact the adhesive connection in the triangular areas adjacent the perforations 36 and 37. The end panel 42 and the severed free portions of the side panels 43 and 44 then are opened up by being rotated 90 degrees relative to the base sheet, as seen in FIG. 5.

The unit also is bent 90 degrees about the score line 14, and the end panel 42 and the remaining portions of the side panels 43 and 44 are opened up by being rotated 90 degrees, as seen in FIG. 6. As a result, there is a receptacle formed by the end panel 41, the adjacent sections of the side edge panels 19 and 20, a new end panel 52 between the score lines 14 and 15, and the encompassed area 53 of the sheet. A lid is provided by the area 54 of the base sheet beyond the score line 15, as well as the end panel 42 and the severed parts of the side edge panels 19 and 20. Bends are formed along the perforations 38 and 39 as the box is folded in this manner.

The box may be closed simply by pivoting the lid downwardly about the score line 15, as seen in FIG. 7, with the end panel 42 fitted over the end panel 41 and the severed portions of the side edge panels 19 and 20 fitting over the portions of the side edge panels forming the receptacle.

Figure 9:
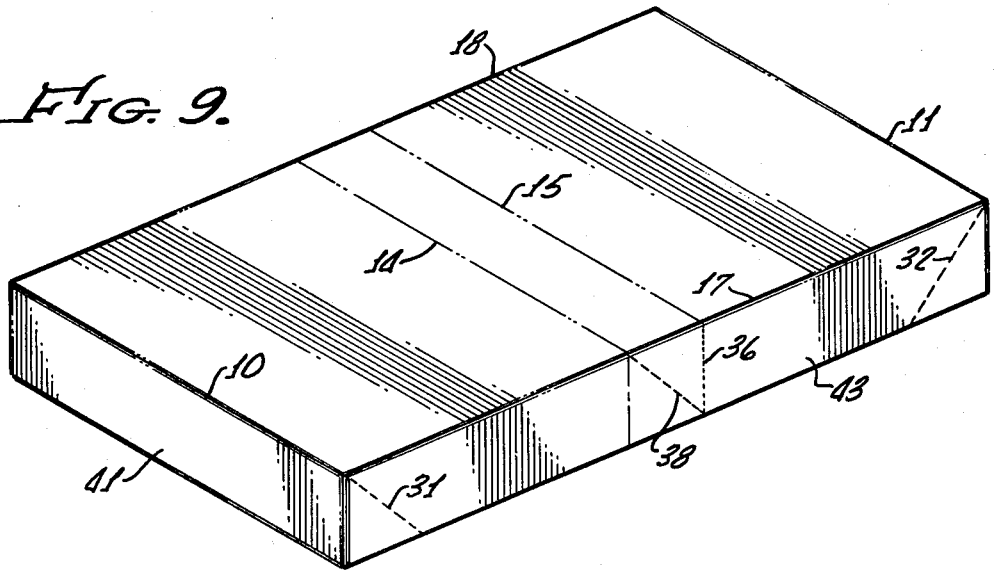
FIG. 9 is a perspective view of the large size box in the closed condition.

Two of the units are employed in making one large box. Again the unit initially is opened up from the position of FIG. 4 to the position of FIG. 2. Then the side panels 43 and 44 in their entireties are opened through an angle of 90 degrees, also rotating the end panels 41 and 42. This is done by tearing the material away from the adhesive 48 holding the triangular sections of the side edge panels 43 and 44 to the bottom sheet. This is readily done when the sheet is of cardboard and a small amount of adhesive 48 is used at these locations. The material is not torn at the perforations 36 and 37. Two units are prepared in this way and fitted together to form one large box by telescoping one unit over the other from the position of FIG. 8 to FIG. 9.

Thus, it is a simple task to provide either size of box from the unit prepared and folded to its storage position of FIG. 4.

The foregoing detailed description is to be clearly understood as given by way of illustration and example only, the spirit and scope of this invention being limited solely by the appended claims.

I claim:

1. An arangement for forming a box comprising
a generally rectangular sheet,
two side edge and two end edge panels of substantially equal width extending around said sheet, and bent 180 degrees about the bases thereof so as to be doubled over said sheet,
said side edge and end edge panels being secured together at their ends so that side edge and end edge panels can be unfolded 90 degrees to define interconnected upstanding walls,
releasable means securing localized central portions of said side edge panels to said sheet,
said side edge panels including frangible portions adjacent said releasable means for permitting each of said side edge panels to be severed into two sections,
said sheet and said side edge panels including bend line means providing lines along which the same are relatively easily bent and arranged such that upon severing said side edge panels at said frangible portions, portions of said sheet intermediate said releasable means can form one wall of a box when said side edge and end edge panels are unfolded,
said sheet on one side of said wall, the severed portions of said side edge panels and one of said end edge panels forming a lid, and said sheet on the other side of said wall, the remaining portions of said side edge panels and the other of said end panels forming a receptacle of a relatively small box,
and alternatively, said releasable means can be released so that said side edge panels and said end edge panels when so unfolded cooperate with said sheet to form one-half of a relatively large box.

2. A device as recited in claim 1 in which said sheet and said side and end edge panels are cardboard and said releasable means is adhesive which is releasable by tearing away from said cardboard.

3. A device as recited in claim 1 in which said bend line means so provides two parallel lines at the central portion of said sheet, one of said lines extending also across said side edge panels, said frangible portions being perforations extending from the ends of the other of said parallel lines across said side edge panels.

4. A device as recited in claim 3 in which said two parallel lines straddle and are equally spaced from the transverse axis of said sheet.

5. An arrangement for forming a box comprising
a generally rectangular sheet,
two side edges and two end edge panels of substantially equal width extending around said sheet, and bent 180 degrees about the bases thereof so as to be doubled over said sheet, said side edge and end edge panels being secured together at their ends so that said side edge and end edge panels can be unfolded 90 degrees to define interconnected upstanding walls, said sheet and said side edge panels having a plurality of bend lines along which said sheet and said side edge panels are relatively easily bendable, said bend lines including first and second bend lines parallel to and positioned one on either side of the transverse axis of said sheet and spaced apart a distance corresponding to the width of said side and end edge panels, said first bend line extending the full width of said sheet and across said side edge panels to the outer edges thereof, said second bend line extending the full width of said sheet between the bases of said side edge panels, said side edge panels having first and second linearly frangible portions forming extensions of the opposite ends of said second bend lines and extending between the bases of said side edge panels and the outer edges thereof, said side edge panels including third and fourth bend lines, said third bend line extending from the outer edge of said one of said side edge panels at one end of one of said linearlly frangible portions to the base of said one side edge panel where said base intersects said first bend line, thereby forming a triangular portion of said one side edge panel bounded by said first linear frangible portion, said third bend line and a portion of the base of said one side edge panel, said fourth bend line extending from the outer edge of the other said side edge panels at one end of the other of said linearlly frangible portions to the base of said other side edge panel where the same intersects said first bend line, thereby forming a triangular portion of said other side edge panel bounded by said second linearlly frangible portion, said fourth bend line and a portion of the base of said other side edge panel, and separable adhesive means securing each of said triangular portions to the adjacent portion of said sheet, whereby said side edge panels can be severed along said first and second linearlly frangible portions and bent along said first, third and fourth bend lines to form a receptacle with an integral lid pivotal about said second bend line when said side edge panels are so unfolded, and alternatively said separable adhesive means can be separated for permitting said side edge panels to be so unfolded along their entire lengths so that said side edge and end edge panels when unfolded cooperate with said sheet to form one-half of a box.

6. A device as recited in claim 5 in which for said linearlly frangible portions said side edge panels are perforated.

7. A device as recited in claim 5 in which said sheet and said side edge and end edge panels are of cardboard.

8. A device as recited in claim 5 in which said sheet and said side edge and end edge panels are integral.

9. A device as recited in claim 8 in which said sheet and said side edge panels are doubled over at said first bend line for minimizing dimensions, and are unfoldable 180 degrees about said first bend line for permitting said sheet and said side edge and end edge panels to be so formed into a box or one-half of a box.

* * * * *

UNITED STATES PATENT AND TRADEMARK OFFICE

CERTIFICATE OF CORRECTION

PATENT NO. : 4,452,367

DATED : June 5, 1984

INVENTOR(S) : Sam Wein

It is certified that error appears in the above-identified patent and that said Letters Patent are hereby corrected as shown below:

IN THE ABSTRACT:

Line 6, delete "linesare" and insert ---lines are---

Column 1, lines 26 and 27, delete "commerical" and insert ---commercial---

Claim 1, line 8, after "that" insert ---said---

Signed and Sealed this

*Twenty-first* Day of *May 1985*

[SEAL]

*Attest:*

DONALD J. QUIGG

*Attesting Officer*

*Acting Commissioner of Patents and Trademarks*